United States Patent [19]

Andrews

[11] Patent Number: 4,806,076

[45] Date of Patent: Feb. 21, 1989

[54] RADIAL UPBLAST EXHAUST FAN APPARATUS

[75] Inventor: John S. Andrews, South Glamorgan, United Kingdom

[73] Assignee: Strobic Air Corporation, Bensalem, Pa.

[21] Appl. No.: 158,552

[22] Filed: Feb. 22, 1988

[51] Int. Cl.[4] ..... F04D 29/44

[52] U.S. Cl. ..... 415/209; 98/78; 98/81; 415/213 C; 415/216

[58] Field of Search ..... 98/42.02, 78, 81; 110/162; 415/209, 213 C, 216

[56] References Cited

U.S. PATENT DOCUMENTS

| | | | |
|---|---|---|---|
| 297,972 | 5/1884 | Day . | |
| 736,748 | 8/1903 | LeBeav . | |
| 1,126,348 | 1/1915 | Basman . | |
| 1,296,040 | 3/1919 | Bontya | 110/162 |
| 1,346,633 | 7/1920 | Cloud . | |
| 1,394,735 | 10/1921 | Jordan . | |
| 1,891,860 | 12/1932 | Woolf | 98/78 |
| 1,986,176 | 1/1935 | Zwerling | 98/72 |
| 2,188,564 | 1/1940 | Berg | 98/78 |
| 2,363,733 | 11/1944 | Karol | 98/84 |
| 2,605,693 | 8/1952 | Hansen | 98/84 |
| 3,045,579 | 7/1962 | Jenn et al. | 98/42.02 |
| 3,069,071 | 12/1962 | Carlson | 415/209 X |
| 3,087,409 | 4/1963 | Carr | 98/84 |
| 3,209,670 | 10/1965 | Twickler | 98/84 |
| 3,285,567 | 11/1966 | Richardson | 415/209 X |
| 3,347,147 | 10/1967 | Howard | 98/78 |
| 3,719,032 | 3/1973 | Cash | 55/264 |

*Primary Examiner*—Harold Joyce

*Attorney, Agent, or Firm*—Sperry, Zoda & Kane

[57] ABSTRACT

A radial upblast exhaust fan apparatus including a main housing having a fan housing in the lower portion thereof and an upper housing thereabove. A passive zone is defined between two lateral sections of the upper housing such as to divide the air flow path into two sections. The passive zone section defines a first inner wall and a second inner wall which cooperate with a first outer wall and a second outer wall defined by the upper housing to provide a first exhaust flow path and a second exhaust flow path. These walls are shaped as sectors of conical sections preferably and include end walls to isolate the first exhaust flow path from fluid flow communication with respect to the second exhaust flow path. A fan means is positionable within the fan housing to urge exhaust gases to flow upwardly through the exhaust paths. The walls of the exhaust flow paths are generally arcuate to facilitate exhaust flow. A wind band may be secured to the upper end of the exhaust housing adjacent the exhaust openings therein in spaced relation to the outer wall of the upper housing by usage of a wind band bracket. In this manner mixing of exhaust gases with ambient air is greatly facilitated. The drive for the fan may be positioned pg,2 within the passive zone or externally with a belt drive device positioned within the band zone and connected operationally to the dirve being externally located.

22 Claims, 2 Drawing Sheets

RADIAL UPBLAST EXHAUST FAN APPARATUS

BACKGROUND OF THE INVENTION

1. Field Of The Invention

The present invention deals with the field of devices normally used secured to the roof areas of buildings which house areas which tend to accumulate airborne contaminants therein. The main function of an upblast fan is to provide a high velocity upwards directed jet which carries the exhaust gases as high as possible above the roof line of the building so as to ensure an effective final dilution of the gases within the greatest possible volume of ambient air and their dispersal over a large area with maximum dilution.

2. Description Of The Prior Art

Prior art devices have been designed to achieve the ventilation as above described such as U.S. Pat. Nos. 297,972 patented May 6, 1884 to H. L. Day on a Ventilating Flue Cap; 736,748 patented Aug. 18, 1903 to J. F. LeBeau on a Chimney Top And Ventilator; 1,126,348 patented Jan. 26, 1915 to A. M. Basman on a Ventilator Hood; 1,346,633 patented July 13, 1920 to O. E. Cloud on a Ventilator; 1,394,735 patented Oct. 25, 1921 to P. J. Jordan on a Ventilator Apparatus; 1,986,176 patented Jan. 1, 1935 to H. Zwerling on a Ventilator; 2,188,564 patented Jan. 30, 1940 to E. N. Berg on a Draft Regulator For Chimneys; 2,363,733 patented Nov. 28, 1944 to J. Karol on a Ventilator; 2,605,693 patented Aug. 5, 1952 to M. R. Hansen on a Ventilating Cap For Chimneys And The Like; 3,087,409 patented Apr. 30, 1963 to J. H. Carr on a Vent Cowl; 3,209,670 patented Oct. 5, 1965 to R. F. Twickler on a Ventilator For Gas Exhaust Stacks; 3,347,147 patented Oct. 17, 1967 to B. O. Howard on an Exhauster Including Venturi Means; and 3,719,032 patented Mar. 6, 1973 to G. H. Cash on an Induction Condenser.

SUMMARY OF THE INVENTION

The present invention provides a radial upblast exhaust fan apparatus including a main housing having a fan housing in the lower portion thereof defining a fan inlet therein to receive air to be exhausted. A fan outlet is also defined by the fan housing to facilitate the expulsion of air to be exhausted therefrom.

An upper housing is positioned immediately above the fan housing and includes a first outer wall section and a second outer wall section each being approximately shaped as a sector of a partial conical section and being concave with respect to one another and being oppositely positioned with respect to one another on the upper housing. The upper housing is in fluid flow communication with respect to the fan housing through the fan outlet to receive exhaust gases therefrom for expelling. Furthermore the upper housing defines a first upper air outlet and a second upper air outlet for releasing exhaust gases therefrom. The upper housing also defines a central nozzle for collection and guidance of the primary dilution air to the negative pressure area partially or wholly encompassed at the discharge plane by the first upper outlet and the second upper outlet for the discharge of the exhaust gases therefrom and their primary dilution.

A passive zone section is positioned within the upper housing and defines a passive zone chamber centrally located therein. The passive zone provides ambient air to be drawn upward in such a manner as to be induced into mixing with the exhausted gases. The direction of flow of air from this passive zone is substantially axial but the direction of flow of the outer two paths is curvilinear towards the axis of the unit and at the discharge of velocity the main velocity flow lines are radially displaced from the vertical axis of the unit. The passive zone section includes a first inner wall section positioned in spaced relation with respect to the first outer wall section of the upper housing. The first inner wall section is approximately shaped as a partial conical section in such a manner as to be convex toward the first inner wall section to define a first exhaust flow path therebetween. In this manner the first exhaust flow path will be adapted to receive exhaust gases from the fan outlet and guide them to upward release through the first upper air outlet.

The passive zone section will also define a second inner wall section positioned in spaced relation with respect to the second outer wall section of the upper housing. This second inner wall section will be approximately shaped conically arcuate and will be convex toward the second inner wall section to define a second exhaust flow path therebetween. This second exhaust flow path is adapted to receive exhaust gases from the fan outlet and guides them to release upwardly through the second upper air outlet. A first end wall means is positioned extending from the first inner wall section to the first outer wall section in at least one location to confine gases passing therebetween to the first exhaust flow path. In a similar manner a second end wall means including at least one second end wall will extend from the second inner wall section to the second outer wall section to confine gases passing therebetween within the second exhaust flow path.

A fan may be positioned within the fan housing to be adapted to draw air for exhausting in through the fan inlet means and expel air for exhausting out through the fan outlet means into the first exhaust flow path and a second exhaust flow path and on upwardly through the first and second upper air outlets. The first and second inner and outer wall sections will be generally arcuate and will show various cross sections depending at which angle the cross section is taken through the main housing of the present invention. The walls can be inclined toward one another, away from one another or can extend toward and then away from one another to thereby define an intermediate point of closest lateral dimension.

The radial upblast exhaust fan apparatus of the present invention can include two or more vertical flow paths and thus two or more upper contaminated air outlets. The present invention defines basically one on one side and one on another with a passive zone therebetween. Each of these can be divided into multiple sections such that any number of individual upper flow paths can be defined positioned circumferentially about the passive zone.

A wind band may be included positioned circumferentially about the first upper air outlet and the second upper air outlet and the upper portion of the upper housing. A wind band bracket may be fixedly secured with respect to the upper housing and with respect to the wind band to hold the wind band extending vertically and in spaced relation with respect to the upper end of the upper housing to induce the flow of ambient gas from therebelow to mix with an dilute the gases being exhausted from the first upper air outlet and the second upper air outlet. This will be achieved by orientation of the wind band peripherally about the upper openings defined in the upper housing and generally parallel with respect to the outer surface of the upper housing.

It is an object of the present invention to provide a radial upblast exhaust fan apparatus wherein the number of moving parts is minimized.

It is an object of the present invention to provide a radial upblast exhaust fan apparatus wherein maintenance costs are minimized.

It is an object of the present invention to provide a radial upblast exhaust fan apparatus wherein down time is minimized.

It is an object of the present invention to provide a radial upblast exhaust fan apparatus wherein high flow rate of diluted exhaust gases is achievable.

It is an object of the present invention to provide a radial upblast exhaust fan apparatus wherein a wind band is included to maximize mixing of ambient environmental air with respect to the gases being exhausted.

It is an object of the present invention to provide a radial upblast exhaust fan apparatus wherein initial capital cost is minimized.

It is an object of the present invention to provide a radial upblast exhaust fan apparatus wherein maintenance operations are greatly facilitated by providing easy access to all operating parts.

It is an object of the present invention to provide a radial upblast exhaust fan apparatus wherein dual exhaust paths are achieved by the use of a single exhausting fan and drive therefore.

It is an object of the present invention to provide a radial upblast exhaust fan apparatus wherein air is induced to mix with the polluted air at the time of exhausting from the fan rather than being added as additional air underneath the fan thereby generating tremendous operational savings.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

DETAILED DESCRIPTION OF THE PREFERRED EMBODIMENT

Figure 1:
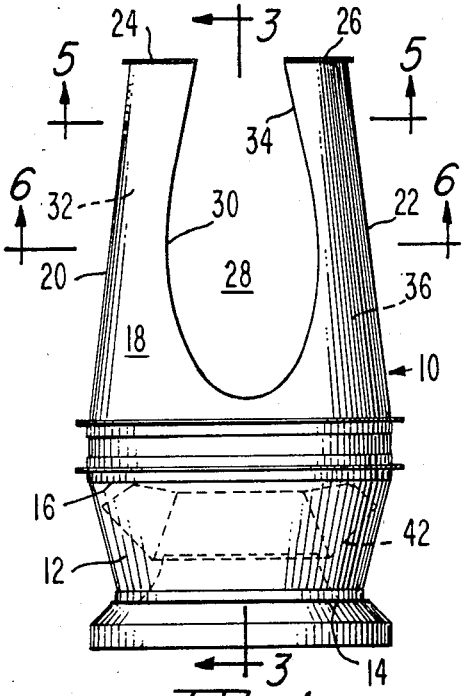
FIG. 1 is a front plan view of an embodiment of the radial upblast exhaust fan apparatus of the present invention.

The present invention provides a radial upblast exhaust fan apparatus which includes a main housing 10 having a fan housing 12 in the lower section thereof and an upper housing 18 positioned above the fan housing and extending upwardly therefrom. Fan housing 12 defines a fan inlet 14 adapted to receive gases for exhausting thereabove and a fan outlet means 16 for allowing movement of the gases upwardly from the fan housing into the upper housing 18.

Upper housing 18 defines a first outer wall section 20 and a second outer wall section 22 being generally conical sections and being concave with respect to one another.

The upper housing 18 defines a first upper air outlet 24 and a second upper air outlet 26 at the uppermost portion thereof. A passive zone section 28 defining a passive zone chamber 48 is located between the first outer wall section 20 and the first upper air outlet 24 and the second outer wall section 22 and the second upper air outlet 26. The passive zone supplies air for mixing by induction into the contaminated air being exhausted through the two upper outlets.

Passive zone section 28 defines a first inner wall section 30 which is shaped as a conical section being convex facing outwardly toward said first outer wall section 20. A first exhaust flow path 32 is defined between the first inner wall section 30 and the first outer wall section 20.

In a similar manner the passive zone section 28 will define a second inner wall section 34 which is shaped as a conical section and is convex facing outwardly and in spaced relation with respect to the second outer wall section 22 to define a second exhaust flow path 36 therebetween.

Figure 5:
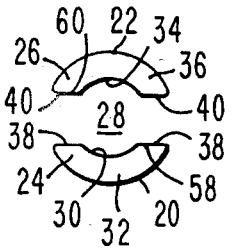
FIG. 5 is a cross sectional view of an embodiment of the upper housing of the present invention as shown in FIG. 1 along lines 5—5.
Figure 6:
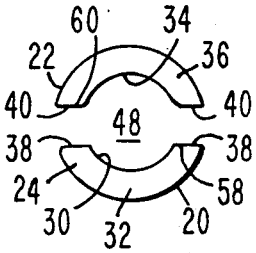
FIG. 6 is a cross sectional view of an embodiment of the upper housing of the present invention as shown in FIG. 1 along lines 6—6.

A first end wall means 38 which may take the form of two end walls 58 may be positioned extending between the first inner wall section 30 and the first outer wall section 20. These end walls as shown best in FIGS. 5 and 6 aid in the definition of the first exhaust flow path 32. In a similar manner the second end wall means 40 which may take the form two second end walls 60 can be positioned extending from the second inner wall section 34 to the second outer wall section 22 to facilitate in defining of the second exhaust flow path 36.

Figure 7:
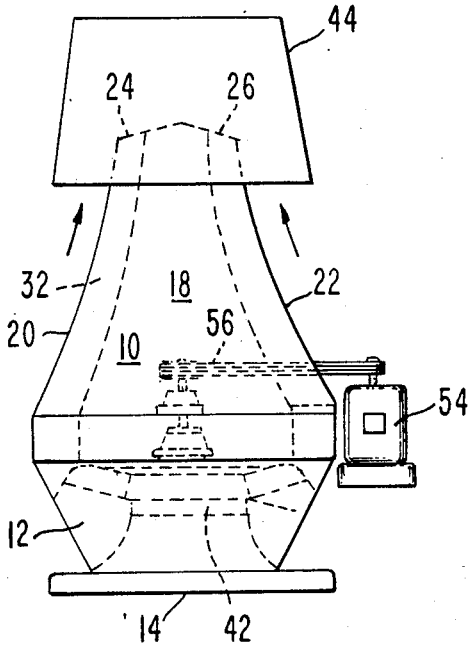
FIG. 7 is a front plan view of an alternative embodiment of the radial upblast exhaust fan apparatus of the present invention showing a remotely positioned embodiment of the fan drive means.

To facilitate the flow of air to be exhausted through the first and second exhaust flow paths a fan means 42 may preferably be positioned within the fan housing 12. A fan means is operatively connected with respect to a fan drive 54 to control operation thereof. Fan drive means 54 may be positioned within the passive zone chamber 48 or may be positioned externally from the main housing 10 of the present invention as shown in FIG. 7. In the configuration shown in FIG. 7 a belt drive means 56 may be included positioned within the passive zone section 28 and may be operatively secured with respect to the drive means 54 which itself may be secured with respect to the outer portion of the main housing means 10.

Figure 4:
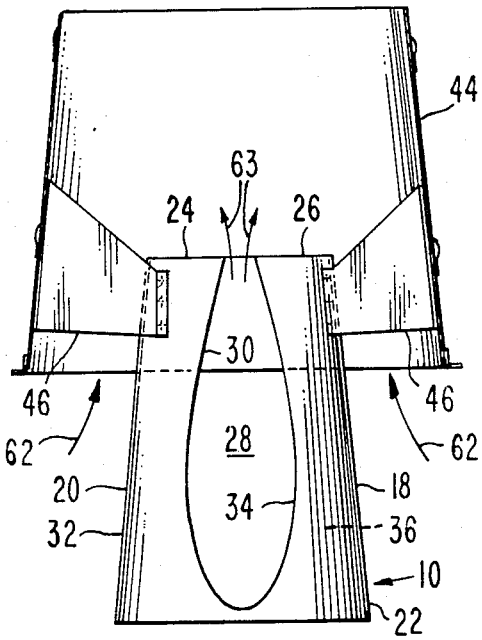
FIG. 4 is a front plan view of a embodiment of the radial upblast exhaust fan apparatus of the present invention showing the usage of a wind band positioned therearound.

To facilitate mixing of the exhausted gas with the ambient environmental gases a wind band 44 may be positioned vertically extending in general parallel relationship with respect to the upper end of the upper housing 18. Preferably the wind band 44 is located in spaced relation with respect to the outer walls of the upper housing 18 by a wind band bracket means 46. In this manner when gases are exhausted through the first upper air outlet 24 and the second upper air outlet 26 air will be induced to flow as shown in FIG. 4 by arrows 62. Air will also be induced to flow from the passive zone chamber 48 upwardly as shown by arrow 63 into the contaminated gases being exhausted through the two upper outlets to facilitate mixing therewith. In conventional upblast exhaust fans air is normally power driven into the apparatus to mix with the exhausting air prior to release thereof. In the present invention this mixing occurs immediately upon movement of the exhausting gases outwardly through the upper outlets 24 and 26.

Figure 2:
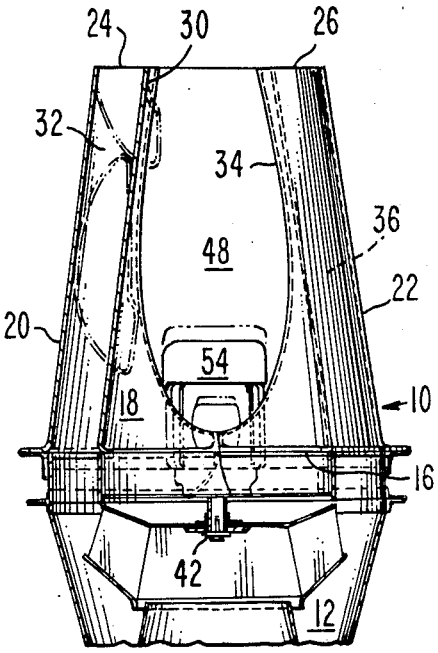
FIG. 2 is a front cross sectional view of an embodiment of the radial upblast exhaust fan apparatus as shown in FIG. 1.
Figure 3:
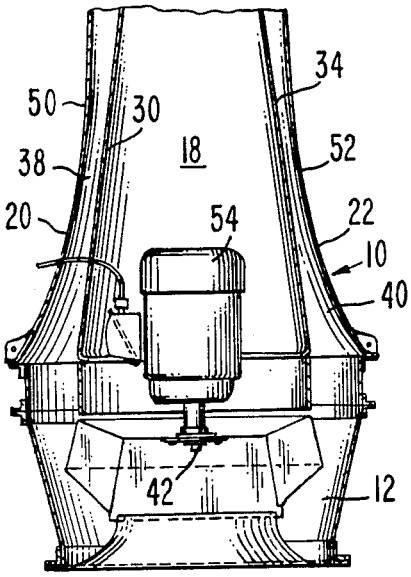
FIG. 3 is a side cross sectional view of an embodiment of the present invention as taken along lines 3—3 in FIG. 1.

The configuration of the arcuate shapes of the first inner wall section 30, the second inner wall section 34, the first outer wall section 20 and the second outer wall section 22 is quite important to the present invention. The cross section shown in FIG. 3 is perpendicular through a horizontally extending plane with respect to the cross section shown in FIG. 2. As such the shape of the first exhaust flow path 32 and the second exhaust flow path 36 in FIG. 2 is shown to be parallel and vertically extending inclined inwardly toward the passive zone. In FIG. 3 however the view is along lines 3—3 in FIG. 1 and as such the external surface of the first and second end wall means 38 and 40 are shown therein. These walls show a configuration with a first intermediate point 50 positioned in the outer wall of first end wall means 38 and a second intermediate point 52 positioned in the outer wall of second end wall means 40. Thus we see that the cross section through the exhaust flow paths are as shown in FIG. 2 when taken through the central portion thereof and tend to assume the shape of the outer surface of the first and second end wall means 38 and 40 shown in FIG. 3 toward the outer peripheral edges of the first and second exhaust flow paths 32 and 36. The usage of the conical sections for the walls defining the exhaust flow paths is of a primary importance in the present invention in view of the high volume of air flow which must be encountered by such upblast exhausting systems.

The radial upblast exhaust fan apparatus of the present invention can include two or more vertical flow paths and thus two or more upper contaminated air outlets. The present invention defines basically one on one side and one on another with a passive zone therebetween. Each of these can be divided into multiple sections such that any number of individual upper flow paths can be defined positioned circumferentially about the passive zone.

While particular embodiments of this invention have been shown in the drawings and described above, it will be apparent, that many changes may be made in the form, arrangement and positioning of the various elements of the combination. In consideration thereof it should be understood that preferred embodiments of this invention disclosed herein are intended to be illustrative only and not intended to limit the scope of the invention.

I claim:

1. A radial upblast exhaust fan apparatus comprising:

(a) main housing means comprising:

(1) a fan housing defining a fan inlet means to receive air to be exhausted and a fan outlet means to expel air to be exhausted;

(2) an upper housing positioned immediately above said fan housing and including a first outer wall section and a second outer wall section each approximately shaped as a partial conical section being concave toward each other and being oppositely positioned with respect to one another, said upper housing being in fluid flow communication with said fan housing through said fan outlet means to receive exhaust gases therefrom for expelling, said upper housing defining at least one first upper air outlet and at least one second upper air outlet for releasing exhaust gases therefrom;

(3) a passive zone section positioned within said upper housing, said passive zone section including:

(a) a first inner wall section positioned in spaced relation with respect to said first outer wall section of said upper housing, said first inner wall section being approximately shaped as a partial conical section being convex toward said first outer wall section to define at least one first exhaust flow path therebetween adapted to receive exhaust gases from said fan outlet means and guide same to release upwardly through said first upper air outlet;

(b) a second inner wall section positioned in spaced relation with respect to said second outer wall section of upper housing, said second inner wall section being approximately shaped as a partial conical section being convex toward said second inner wall section to define at least one second exhaust flow path therebetween adapted to receive exhaust gases from said fan outlet means and guide same to release upwardly through said second upper air outlet;

(c) at least one first end wall means extending from said first inner wall section to said first outer wall section to confine gases passing therebetween within said first exhaust flow path;

(d) at least one second end wall means extending from said second inner wall section to said second outer wall section to confine gases passing therebetween within said second exhaust flow path; and (b) a fan means positioned within said fan housing and adapted to draw air for exhausting in through said fan inlet means and expel air for exhausting out through said fan outlet means into said first exhaust flow path and said second exhaust flow path.

2. A radial upblast exhaust fan apparatus as defined in claim 1 including one first end wall means and one second end wall means and wherein said upper housing defines one first upper air outlet and one second upper air outlet and wherein said first inner wall section and said first outer wall section define one first exhaust flow path therebetween and wherein said second inner wall section and said second outer wall section define one second exhaust flow path therebetween.

3. A radial upblast exhaust fan apparatus as defined in claim 2 wherein said first inner wall section is inclined upwardly and inwardly toward said first outer wall section to taper said first exhaust flow path to a smaller lateral dimension in the upper area thereof.

4. A radial upblast exhaust fan apparatus as defined in claim 2 wherein said first outer wall section is inclined upwardly and inwardly toward said first inner wall section to taper said first exhaust flow path to a smaller lateral dimension in the upper area thereof.

5. A radial upblast exhaust fan apparatus as defined in claim 2 wherein said second inner wall section is inclined upwardly and inwardly toward said second outer wall section to taper said second exhaust flow path to a smaller lateral dimension in the upper area thereof.

6. A radial upblast exhaust fan apparatus as defined in claim 2 wherein said second outer wall section is inclined upwardly and inwardly toward said second inner wall section to taper said second exhaust flow path to a smaller lateral dimension in the upper area thereof.

7. A radial upblast exhaust fan apparatus as defined in claim 2 further including a wind band positioned circumferentially around said first upper air outlet and said second upper air outlet and the upper portion of said upper housing, said wind band extending vertically and in spaced relation with respect to the upper end of said upper housing to induce the flow of environmental gas from therebelow to mix with and dilute the gases being exhausted from said first upper air outlet and said second upper air outlet.

8. A radial upblast exhaust fan apparatus as defined in claim 7 further comprising a wind band bracket means secured with respect to said upper housing and attached with respect to said wind band for retaining thereof in spaced relation to said upper housing.

9. A radial upblast exhaust fan apparatus as defined in claim 2 wherein said passive zone section includes a passive zone chamber positioned between said first exhaust flow path and said second exhaust flow path.

10. A radial upblast exhaust fan apparatus as defined in claim 2 wherein said first outer wall section and said first inner wall section are parallel with respect to one another vertically to define said first exhaust flow path of constant lateral dimension, said first outer wall section and said first inner wall section being inclined upwardly and inwardly.

11. A radial upblast exhaust fan apparatus as defined in claim 2 wherein said second outer wall section and said second inner wall section are parallel with respect to one another vertically to define said second exhaust flow path of constant lateral dimension, said second outer wall section and said second inner wall section being inclined upwardly and inwardly.

12. A radial upblast exhaust fan apparatus as defined in claim 2 wherein said first inner wall section is linearly straight vertically and wherein said first outer wall section is vertically arcuate with respect thereto.

13. A radial upblast exhaust fan apparatus as defined in claim 12 wherein said first exhaust flow path defined by said first outer wall section and said first inner wall section includes a first intermediate point of least lateral dimension, said first inner wall section and said first outer wall section being tapered away with respect to one another in both the upwardly and downwardly extending directions from said intermediate point to increase the lateral dimension of said first exhaust flow path.

14. A radial upblast exhaust fan apparatus as defined in claim 2 wherein said second inner wall section is linearly straight vertically and wherein said second outer wall section is vertically arcuate with respect thereto.

15. A radial upblast exhaust fan apparatus as defined in claim 14 wherein said second exhaust flow path defined by said second outer wall section and said second inner wall section includes a second intermediate point of least lateral dimension, said second inner wall section and said second outer wall section being tapered away with respect to one another in both the upwardly and downwardly extending directions from said intermediate point to increase the lateral dimension of said second exhaust flow path.

16. A radial upblast exhaust fan apparatus as defined in claim 2 further comprising a fan drive means mounted within said passive zone section and operatively connected to said fan means within said fan housing to control operation thereof.

17. A radial upblast exhaust fan apparatus as defined in claim 2 further comprising a belt drive means mounted within said passive zone section and operatively connected to said fan means.

18. A radial upblast exhaust fan apparatus as defined in claim 17 further comprising a fan drive means operatively connected with respect to said belt drive means to remotely control operation of said fan means within said fan housing.

19. A radial upblast exhaust fan apparatus as defined in claim 2 wherein said first end wall means comprises two individual first end walls spatially disposed with respect to one another to define said first exhaust flow path.

20. A radial upblast exhaust fan apparatus as defined in claim 2 wherein said second end wall means comprises two individual second end walls spatially disposed with respect to one another to define said second exhaust flow path.

21. A radial upblast exhaust fan apparatus comprising:

(a) main housing means comprising:

(1) a fan housing defining a fan inlet means to receive air to be exhausted and a fan outlet means to expel air to be exhausted;

(2) an upper housing positioned immediately above said fan housing and including a first outer wall section and a second outer wall section each shaped as a partial conical section being concave toward each other and being oppositely positioned with respect to one another, said upper housing being in fluid flow communication with said fan housing through said fan outlet means to receive exhaust gases therefrom for expelling, said upper housing defining a first upper air outlet and a second upper air outlet for releasing exhaust gases therefrom;

(3) a passive zone section positioned within said upper housing, said passive zone section including:

(a) a first inner wall section positioned in spaced relation with respect to said first outer wall section of said upper housing, said first inner wall section being approximately shapes as a partial conical section being convex toward said first inner wall section to define a first exhaust flow path therebetween adapted to receive exhaust gases from said fan outlet means and guide same to release upwardly through said first upper air outlet, said first inner wall section and said first outer wall section being inclined toward each other in a vertically upward direction to define said first exhaust flow path to be tapered to a smaller lateral dimension upwardly therealong;

(b) a second inner wall section positioned in spaced relation with respect to said second outer wall section of upper housing, said second inner wall section being approximately shaped as a partial conical section being convex toward said second outer wall section to define a second exhaust flow path therebetween adapted to receive exhaust gases from said fan outlet means and guide same to release upwardly through said second upper air outlet, said second inner wall section and said second outer wall section being inclined toward each other in a vertically upward direction to define said second exhaust flow path to be tapered to a smaller lateral dimension upwardly therealong;

(c) a first end wall means extending from said first inner wall section to said first outer wall section to confine gases passing therebetween within said first exhaust flow path, said first end wall means including two individual first end walls spatially disposed with respect to one another to define said first exhaust flow path;

(d) a second end wall means extending from said second inner wall section to said second outer wall section to confine gases passing therebetween within said second exhaust flow path, said second end wall means including two individual second end walls spatially disposed with respect to one another to define said second exhaust flow path;

(e) a passive zone chamber positioned between said first inner wall section and said second inner wall section and between said first end wall means and said second end wall means;

(b) a fan means positioned within said fan housing and adapted to draw air for exhausting in through said fan inlet means and expel air for exhausting out through said fan outlet means into said first exhaust flow path and said second exhaust flow path and upwardly through said first upper air outlet and said second upper air outlet;

(c) a fan drive means mounted within said passive zone section and operatively connected to said fan means within said fan housing to control operation thereof;

(d) a wind band positioned circumferentially around said first upper air outlet and said second upper air outlet and the upper portion of said upper housing, said wind band extending vertically and in spaced relation with respect to the upper end of said upper housing to induce the flow of ambient air from therebelow to mix with and dilute the gases being exhausted from said first upper air outlet and said second upper air outlet; and (e) a wind band bracket means secured with respect to said upper housing and attached with respect to said wind band for retaining thereof in spaced relation with respect to said upper housing.

22. A radial upblast exhaust fan apparatus comprising:

(a) main housing means comprising:

(1) a fan housing defining a fan inlet means to receive air to be exhausted and a fan outlet means to expel air to be exhausted;

(2) an upper housing positioned immediately above said fan housing and including a first outer wall section and a second outer wall section each shaped as a partial conical section being concave toward each other and being oppositely positioned with respect to one another, said upper housing being in fluid flow communication with said fan housing through said fan outlet means to receive exhaust gases therefrom for expelling, said upper housing defining a first upper air outlet and a second upper air outlet for releasing exhaust gases;

(3) a passive zone section positioned within said upper housing, said passive zone section including:

(a) a first inner wall section positioned in spaced relation with respect to said first outer wall section of said upper housing, said first inner wall section being shaped as a partial conical section being convex toward said first outer wall section to define a first exhaust flow path therebetween adapted to receive exhaust gases from said fan outlet means and guide same to release upwardly through said first upper air outlet, said first inner wall section and said first outer wall section being inclined toward each other in a vertically upward direction to define said first exhaust flow path to be tapered to a smaller lateral dimension upwardly therealong;

(b) a second inner wall section positioned in spaced relation with respect to said second outer wall section of upper housing, said second inner wall section being shaped as a partial conical section being convex toward said second outer wall section to define a second exhaust flow path therebetween adapted to receive exhaust gases from said fan outlet means and guide same to release upwardly through said second upper air outlet, said second inner wall section and said second outer wall section being inclined toward each other in a vertically upward direction to define said second exhaust flow path to be tapered to a smaller lateral dimension upwardly therealong;

(c) a first end wall means extending from said first inner wall section to said first outer wall section to confine gases passing therebetween within said first exhaust flow path, said first end wall means including two individual first end wall means including two individual first end walls spatially disposed with respect to one another to define said first exhaust flow path;

(d) a second end wall means extending from said second inner wall section to said second outer wall section to confine gases passing therebetween within said second exhaust flow path, said second end wall means including two individual second end walls spatially disposed with respect to one another to define said second exhaust flow path;

(e) a passive zone chamber positioned between said first inner wall section and said second inner wall section and between said first end wall means and said second end wall means;

(b) a fan means positioned within said fan housing and adapted to draw air for exhausting in through said fan inlet means and expel air for exhausting out through said fan outlet means into said first exhaust path and said second exhaust flow path and upwardly through said first upper air outlet and said second upper air outlet;

(c) a belt driving means mounted within said passive zone section and operatively connected to said fan means within said fan housing to control operation thereof;

(d) a fan drive means mounted externally with respect to said main housing means and being operatively connected with respect to said belt driving means to remotely control operation of said fan means within said fan housing;

(e) a wind band positioned circumferentially around said first upper air outlet and said second upper air outlet and the upper portion of said upper housing, said wind band extending vertically and in spaced relation with respect to the upper end of said upper housing to induce the flow of ambient air from therebelow to mix with and dilute the gases being exhausted from said first upper air outlet and said second upper air outlet; and (f) a wind band bracket means secured with respect to said upper housing and attached with respect to said wind band for retaining thereof in spaced relation with respect to said upper housing.

* * * * *